United States Patent [19]

Noto

[11] Patent Number: 4,878,871

[45] Date of Patent: Nov. 7, 1989

[54] TOY FOR CONVEYING PERSONALIZED MESSAGE

[76] Inventor: Nancy C. Noto, 26 Castle Rock, Branford, Conn. 06405

[21] Appl. No.: 184,761

[22] Filed: Apr. 22, 1988

[51] Int. Cl.[4] ..... A63H 5/00; A63H 3/28; A63H 3/02; G09B 50/60

[52] U.S. Cl. ..... 446/302; 446/297; 446/371; 446/81; 446/901; 434/308

[58] Field of Search ..... 446/302, 299, 369, 370, 446/371, 76, 81, 74, 72, 71, 297, 298, 300, 301, 295, 296, 321, 408, 901, 472; 360/90; 434/272, 308, 309, 311

[56] References Cited

U.S. PATENT DOCUMENTS

| | | | |
|---|---|---|---|
| 1,565,145 | 12/1925 | Henry | 446/297 X |
| 1,927,453 | 9/1933 | Hill | 446/72 X |
| 2,591,379 | 4/1952 | Schradermeier | 446/72 |
| 3,080,679 | 3/1963 | Hardigan | 446/302 |
| 3,159,942 | 12/1964 | Fiske | 446/175 X |
| 3,165,595 | 1/1965 | Noshiro | 446/175 X |
| 3,292,610 | 12/1966 | Newman | 446/301 X |
| 3,483,655 | 12/1969 | Mason | 446/302 |
| 3,504,455 | 4/1970 | Gardel et al. | 446/297 X |
| 3,593,433 | 7/1971 | Dillon | 446/302 X |
| 3,755,960 | 9/1973 | Tepper et al. | 446/299 |
| 3,792,490 | 2/1974 | Wigal | 360/118 X |
| 4,017,905 | 4/1977 | Convertine et al. | 360/90 |
| 4,197,670 | 4/1980 | Cox | 446/901 X |
| 4,547,171 | 10/1985 | Horimoto | 446/370 |
| 4,710,145 | 12/1987 | Vandis | 446/302 X |

FOREIGN PATENT DOCUMENTS

| | | | |
|---|---|---|---|
| 3730491 | 3/1988 | Fed. Rep. of Germany | 446/299 |
| 2413101 | 7/1979 | France | 446/302 |
| 2591501 | 6/1987 | France | 446/302 |

*Primary Examiner*—Robert A. Hafer
*Assistant Examiner*—D. Neal Muir
*Attorney, Agent, or Firm*—Richard A. Craig

[57] ABSTRACT

A method of preparing and conveying a personalized message from a sender to a recipient utilizes a toy having a cavity containing a cassette player, a battery holder, a switch and circuit elements interconnecting the player, the holder and the switch. The method includes the following steps which are performed by the sender: personally taping the personalized message on a cassette; inserting the cassette in the player; and giving the toy to the recipient with the cassette therein. The toy is cuddly and may be in the general likeness of the sender or may be a stuffed animal, in either case having a flap that is movable between a closed position in which the flap covers the cavity and an open position in which the cavity is exposed. The switch is of the push button type and the push buttons produce bulges in the flap when the latter is closed, so that the switch can be operated without moving the flap to its open position.

6 Claims, 3 Drawing Sheets

TOY FOR CONVEYING PERSONALIZED MESSAGE

BACKGROUND OF THE INVENTION

This invention relates to a method of preparing and conveying a personalized message and to a toy which is useful in performing the method.

The personalized message may be designed to comfort, communicate, educate, entertain, or convey special event (such as holiday and birthday) greetings. Among the benefits is rendering family members closer to one another, especially in the common situation where they are separated by many miles. Typical sender (donor)-recipient (donee) combinations include grandparent-granchild or girlfriend-boyfriend, but the possibilities are endless.

Typically, a grandchild might be in a hospital miles from his or her grandparents. A grandparent, having the desire to send a personalized message of comfort, can utilize the invention, in both its method and article aspects to fulfill his or her desire, in a way which is simple, relatively economical and which is likely to be effective.

Important objects hereof are to provide a method of preparing and conveying a personalized message having the foregoing advantages and to provide a toy which is usefull in performing the method.

The reader may be interested in the following U.S. patents as general background:

| U.S. Pat. No. | Date | Inventor |
|---|---|---|
| 3,389,915 | June 25, 1968 | Owen et al. |
| 3,538,638 | November 10, 1970 | Glass et al. |
| 3,580,585 | May 25, 1971 | Stastny et al. |
| 3,636,655 | January 25, 1972 | Porter et al. |
| 3,685,200 | August 22, 1972 | Noll |
| 4,282,676 | August 11, 1981 | Davis |
| 4,521,201 | June 4, 1985 | Spector |

Noll '200 is perhaps the most pertinent of these patents.

Noll discloses a doll that is voiced and animated. Portions of the doll's body are automated to have meaningful positions coordinated with the voice output. It is said that the replay means can be selectively activated with unlimited numbers of cassettes containing amusing as well as educational information, as may be desired. The doll includes a means for receiving a replaceable cassette.

None of these patents appears to teach the utilization of personalized messages aimed specifically at a recipient known to the sender.

SUMMARY OF THE INVENTION

The inventive method of preparing and conveying a personalized message from a sender to a recipient utilizes a toy having a cavity containing a cassette player, a battery holder, a switch and ciruit elements interconnecting the player, the holder and the switch. The method includes the following steps which are performed by the sender: personally taping the personalized message on a cassette; inserting the cassette in the player; and giving the toy to the recipient with the cassette therein.

The inventive toy is cuddly and may be in the general likeness of the sender or may be a stuffed animal, in either case having a flap that is movable between a closed position in which the flap covers the cavity and an open position in which the cavity is exposed. The switch is of the push button type and the push buttons produce bulges in the flap when the latter is closed, so that the switch can be operated without moving the flap to its open position.

DESCRIPTION OF THE INVENTION

The invention will be described as applied to a doll 10, but it is equally applicable to other toys, such as a stuffed animal.

Figure 1:
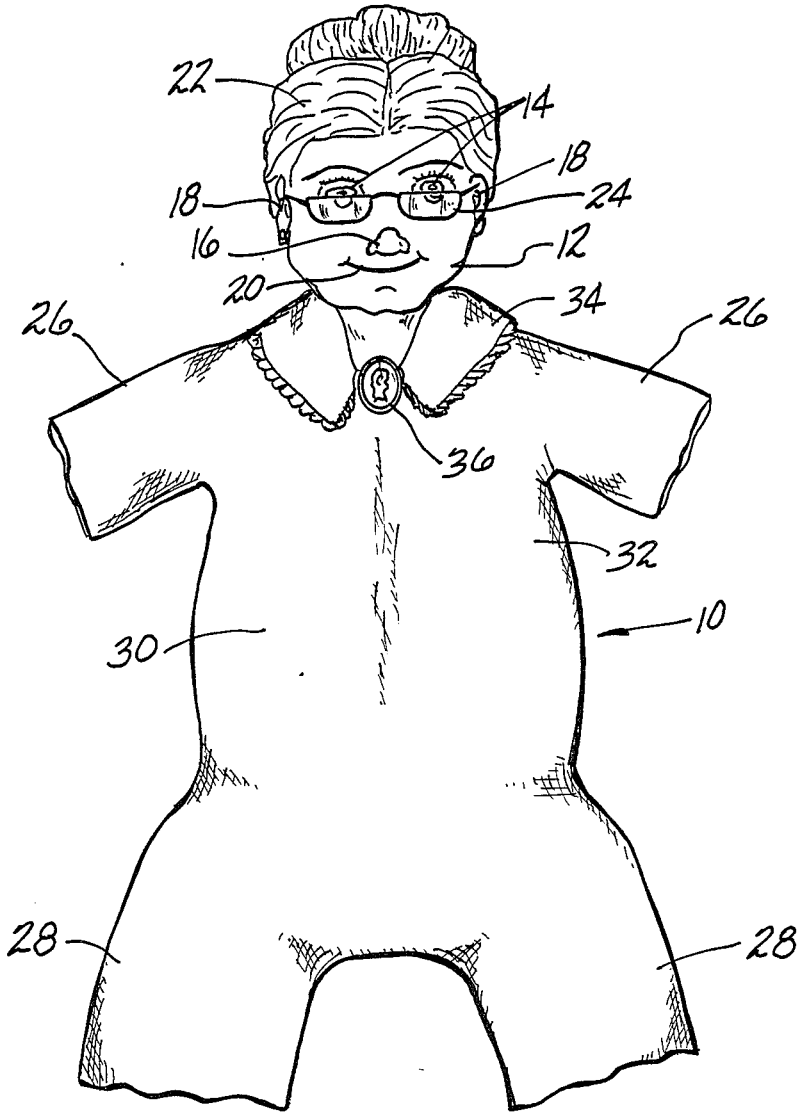
FIG. 1 is a fragmentary front view of a toy which is a preferred embodiment of the invention.

The views show doll 10 fragmentarily. Doll 10 is a preferred embodiment of the invention and is soft and cuddly and has a face 12 (FIG. 1) which is that of a kindly, loving grandmother, including eyes 14, a nose 16, ears 18, a mouth 20 and hair 22. Doll 10 further has spectacles 24, arms 26, legs 28 and a torso 30. In addition, doll 10 may be suitably clad as with a blouse 32 having a collar 34 and a pin 36. Doll 10 may be stuffed and covered with suitable fabric, as appropriate.

Figure 2:
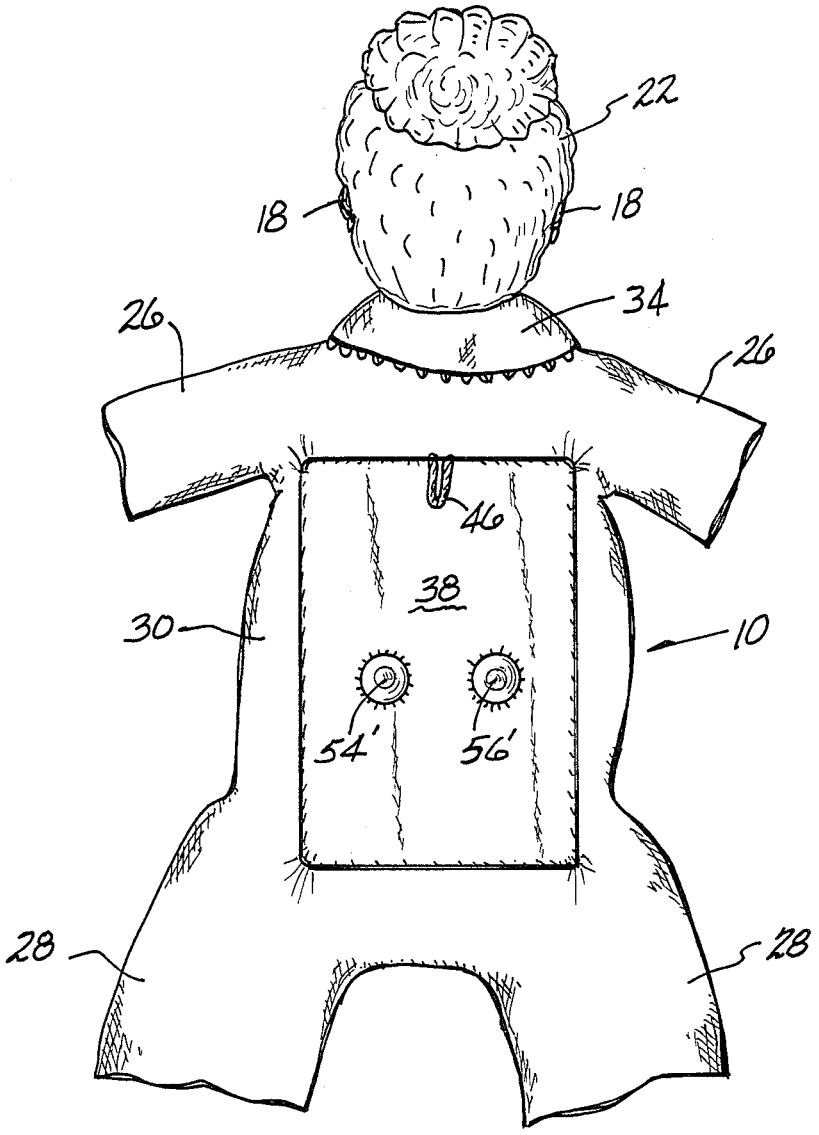
FIG. 2 is a fragmentary rear view of the toy of FIG. 1 in a first mode.
Figure 3:
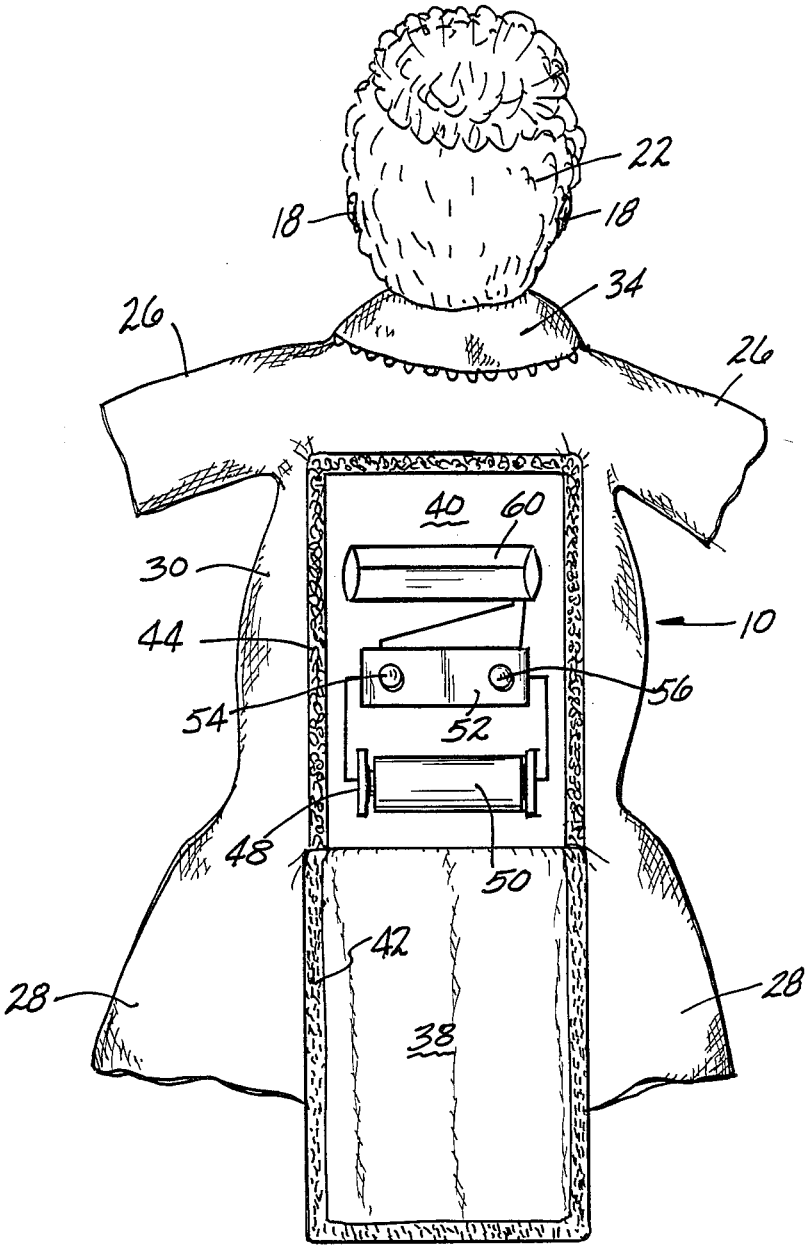
FIG. 3 is a fragmentary rear view of the toy of FIG. 1 in a second mode.

FIGS. 2 and 3 show doll 10 from the rear, in two different modes, namely, a first or closed mode in FIG. 2 and a second or open mode in FIG. 3.

The rear of doll 10 has a rectangular fabric flap 38 which unobtrusively covers a cavity 40 when flap 38 is open, as shown in FIG. 3. More particularly, flap 38 and the portion of the fabric of the back of doll 10 which flap 38 covers in the closed portion of FIG. 2 are provided with hook-and-pile closure as indicated at 42 along three sides of flap 38 and at 44 on corresponding portions of the periphery of cavity 40. Other types of closure, such as snaps or a zipper, can be employed instead of hook-and-pile closure. To aid in moving flap 38 from the closed position to the open position, flap 38 is shown in FIG. 2 with a loop 46 at the top.

Cavity 40 contains, shown schematically, a battery holder 48 with a battery 50, a switch 52 with operating push buttons 54 and 56, a cassette player 60 and conventional circuit elements interconnecting battery holder 48, switch 52 and player 60. Switch 52 is so positioned that, when flap 38 is closed as in FIG. 2, push buttons 54 and 56 will produce slight bulges 54' and 56' in the fabric of flap 38, so that switch 52 can be easily operated by a youngster without opening flap 38.

Doll 10 can be used to convey, via a cassette bearing a personalized message taped by a sender or donor and sent in doll 10 to a recipient or donee. The personalized message may be designed to comfort, communicate, educate, entertain or convey special event (such as holiday and birthday) greetings. Among the benefits is rendering family members closer to one another. Typlical sender (donor)-recipient (donee) combinations include grandparent-grandchild or girlfriend-boyfriend, but the possibilities are endless.

In a typical situation, a grandchild might be in a hospital miles from his or her grandparents. A grandparent could purchase doll 10 in his or her own general likeness, tape a message of comfort on a cassette (not shown), open flap 38, insert the cassette in cassette player 60, close flap 38 and then send doll 10 to the grandchild, in the hospital, where the grandchild can listen to the comforting message while cuddling doll 10.

It is evident that the invention attains the stated objects and advantages and others.

The disclosed details are not to be taken as limitations on the invention except as those details may be included in the appended claims.

What is claimed is:

1. A toy having a cavity containing a cassette player, a battery holder, a switch with an operative push button, electric circuit means interconnecting said player, said holder and said switch, and a flap that is movable between a closed position in which said flap covers said cavity and an open position in which said cavity is exposed, whereby a sender can tape a personal message on a cassette, insert the cassette in said player with said flap in the open position, close said flap and give the toy a recipient with the message-bearing cassette therein, wherein said switch is so positioned that, when said flap is in said closed position, said push button will engage said flap to produce a bulge therein, whereby said switch can be operated without moving said flap to said open position.

2. The toy according to claim 1 wherein said toy is cuddly, having human features.

3. The toy according to claim 1 further comprising means for releasably holding said flap in said closed position.

4. The toy according to claim 3 wherein said holding means is a hook-and-pile closure.

5. the toy according to claim 3 wherein said flap has a loop to facilitate moving said flap from said closed position to said open position.

6. The toy according to claim 1 wherein said flap is made of fabric.

* * * * *